US008128188B2

(12) United States Patent
Muela et al.

(10) Patent No.: US 8,128,188 B2
(45) Date of Patent: Mar. 6, 2012

(54) MONITORING INK FLOW

(75) Inventors: David Ramirez Muela, Barcelona (ES); Francisco Lopez Moral, Castellbisbal (ES); Maria Dinares Argemi, Terrassa (ES); Xavier Gasso Puchal, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 392 days.

(21) Appl. No.: 12/432,847

(22) Filed: Apr. 30, 2009

(65) Prior Publication Data

US 2010/0277520 A1 Nov. 4, 2010

(51) Int. Cl.
*B41J 29/393* (2006.01)

(52) U.S. Cl. ..... 347/19

(58) Field of Classification Search ..... None
See application file for complete search history.

(56) References Cited

U.S. PATENT DOCUMENTS

| | | | | |
|---|---|---|---|---|
| 5,276,468 | A | 1/1994 | Deur et al. | |
| 5,946,007 | A | 8/1999 | Otsuka et al. | |
| 6,193,351 | B1 | 2/2001 | Yaegashi et al. | |
| 6,286,928 | B1 | 9/2001 | Kasamatsu | |
| 6,450,614 | B1 | 9/2002 | Scheffelin et al. | |
| 6,612,673 | B1 * | 9/2003 | Giere et al. | 347/14 |
| 6,685,300 | B1 | 2/2004 | Ishiyama et al. | |
| 6,951,378 | B1 | 10/2005 | Yamada et al. | |
| 7,341,327 | B2 | 3/2008 | Usuda | |
| 2006/0284925 | A1 | 12/2006 | Komplin et al. | |
| 2007/0046710 | A1 | 3/2007 | Barkley et al. | |
| 2009/0015618 | A1 | 1/2009 | Jung et al. | |
| 2009/0058914 | A1 | 3/2009 | Kim et al. | |
| 2011/0122186 | A1 * | 5/2011 | Lebron et al. | 347/14 |

* cited by examiner

*Primary Examiner* — Stephen Meier
*Assistant Examiner* — Tracey McMillion
(74) *Attorney, Agent, or Firm* — Garry A. Perry

(57) ABSTRACT

A system for monitoring ink flow is disclosed. In one embodiment, the system includes a printhead configured to perform a priming event, a heating element, a sensor configured to measure the temperature of a printhead die at a plurality of times, and a processor configured to determine the success of a priming event by comparing an actual cooling rate to a threshold cooling rate.

17 Claims, 6 Drawing Sheets

MONITORING INK FLOW

BACKGROUND OF THE INVENTION

In current inkjet printing systems, printheads are expected to achieve long lives in proper working conditions. In order to provide good reliability some printhead cleaning and maintenance routines are needed. One of the common cleaning methods is priming, which includes forcibly extracting ink from the printhead using either a positive or negative pressure gradient.

There are a number of events that may cause an unsuccessful priming event, including but lot limited to the following:

1. the peristaltic pump is broken, or has leaks;
2. the ink tubes are broken, have leaks or are clogged by ink debris;
3. the vacuum accumulator is clogged by ink residue;
4. the actuator features that act as valves are broken;
5. the service station caps are broken and/or do not provide a good seal;
6. the printhead is clogged and ink can not flow through the nozzles; or
7. the printhead regulator does not open despite the pressure changes in the printhead.

If any one of these events occurs, or a combination of such events occurs, the priming system may not be able to extract ink from the printhead and perform the cleaning routine.

Failure to recognize that priming operations are not properly occurring can result in formation of ink deposits inside and outside the printhead, clogged printhead nozzles, damage to the printhead, and degraded print quality. These conditions can lead to increased cost of ownership and decreased customer satisfaction.

BRIEF DESCRIPTION OF THE DRAWINGS

The accompanying drawings illustrate various embodiments of the principles described herein and are a part of the specification. The illustrated embodiments are merely examples and do not limit the scope of the claims. Throughout the drawings, identical reference numbers designate similar, but not necessarily identical elements.

DETAILED DESCRIPTION OF EMBODIMENTS

In the following description, for purposes of explanation, numerous specific details are set forth in order to provide a thorough understanding of the present systems and methods. It will be apparent, however, to one skilled in the art that the present apparatus, systems, and methods may be practiced without these specific details. Reference in the specification to "an embodiment", "an example" or similar language means that a particular feature is included in at least that one embodiment, but not necessarily in other embodiments. The various instances of the phrase "in one embodiment" or similar phrases in various places in the specification are not necessarily all referring to the same embodiment. The terms "comprises/comprising", "has/having", and "includes/including" are synonymous, unless the context dictates otherwise.

The accompanying drawings illustrate various embodiments of the principles described herein and are a part of the specification. The illustrated embodiments are merely examples and do not limit the scope of the claims. Throughout the drawings, identical reference numbers designate similar, but not necessarily identical elements.

Embodiments of the invention provide a system for monitoring ink flow, including a printhead, with a printhead die, configured to perform a priming event, a heating element, a sensor configured to measure the temperature of the printhead die at a plurality of times, and a processor configured to calculate an actual cooling rate utilizing the measurements taken by the sensor and to determine the success of priming events by comparing the actual cooling rate to a threshold cooling rate.

Embodiments of the invention further provide a method for monitoring ink flow, including utilizing a heating element and the sensor to raise the temperature of the printhead die to a start-priming temperature, performing a priming event, utilizing the sensor to make a plurality of measurements of the temperature of the printhead die, calculating an actual cooling rate utilizing the temperature measurements, and determining the success of the priming event by comparing the actual cooling rate to a threshold cooling rate.

Embodiments of the invention further provide a computer-readable medium having computer executable instructions thereon which, when executed, cause a processor to perform a process for monitoring ink flow, including utilizing a heating element and the sensor to raise the temperature of the printhead die to a start-priming temperature, performing a priming event, utilizing the sensor to make a plurality of measurements of the temperature of the printhead die, calculating an actual cooling rate utilizing the temperature measurements, and determining the success of the priming event by comparing the actual cooling rate to a threshold cooling rate.

Figure 1:
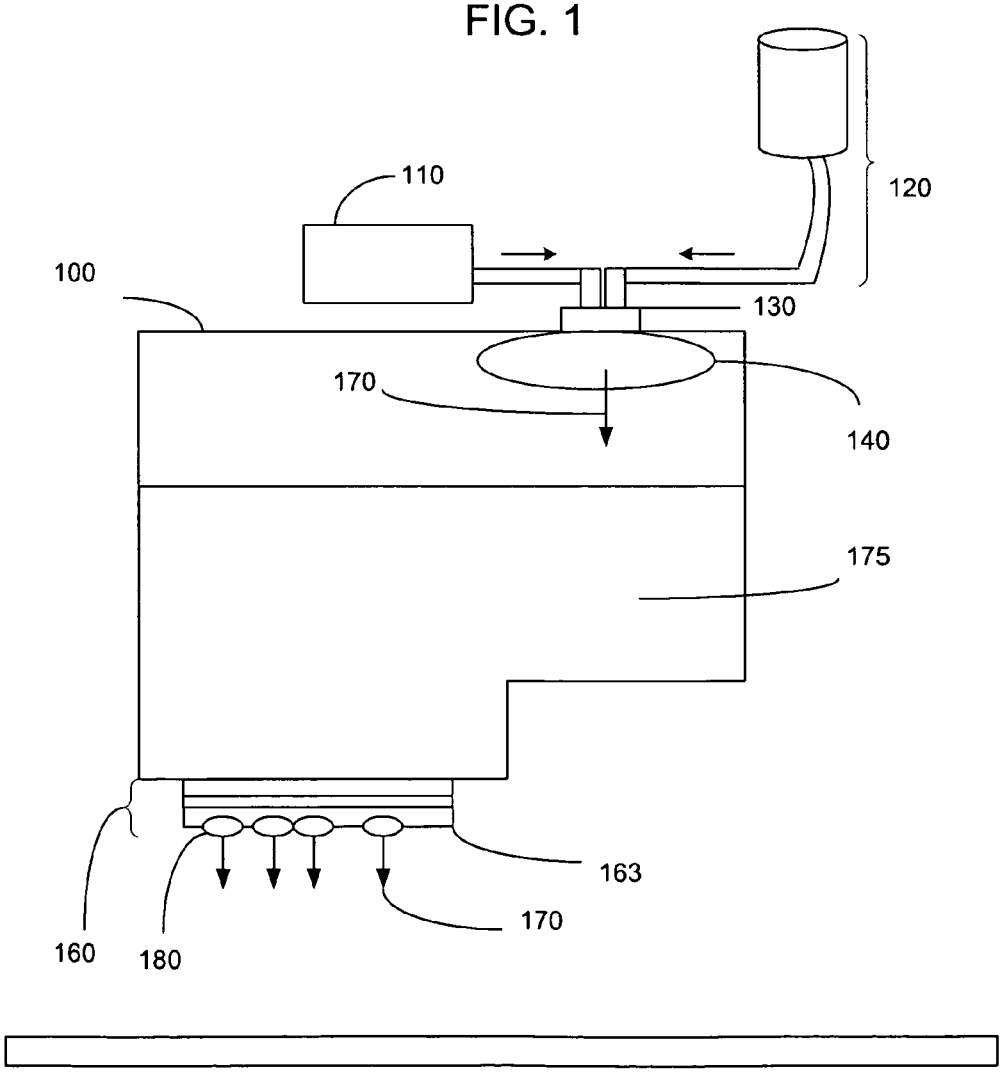
FIG. 1 is a diagram showing a side view of a printhead including a printhead die, and a system for monitoring ink flow to confirm the success of a priming event, both according to one embodiment of the invention.

FIG. 1 is a diagram showing a side view of a printhead including a printhead die, and a system for monitoring ink flow to confirm the success of a priming event, both according to one embodiment of the invention.

In an embodiment, a system for monitoring ink flow to confirm the success of a priming event involves a priming step comprising forcibly extracting ink from a printhead 100 using either a positive or negative pressure gradient.

In an embodiment printhead 100 is a thermal system inkjet printhead including a printhead die 160. As used in this specification and the appended claims, "printhead" suggests a mechanism that ejects ink drops toward a print medium, such as a sheet of paper, so as to print onto the print medium. As defined herein and in the appended claims, "printhead die" shall be broadly understood to mean a portion or portions of a printhead in which thermal ejection chambers and nozzles are situated. In an embodiment a printhead die 160 may be formed from a single element, or from a plurality of elements.

In an embodiment a printhead die 160 is fabricated from a silicon substrate having heating elements in the form of thin film resistors and associated circuitry deposited on top of the silicon layer. The resistors may be arranged in an array relative to one or more ink supply slots in the substrate, and a barrier material may be formed on the substrate around the resistors to isolate each resistor inside a thermal ejection chamber. The barrier material may be shaped both to form the thermal ejection chambers, and to provide fluid communication between the thermal ejection chambers and the ink supply slot. The composite assembly described in this paragraph is typically capped by a nozzle plate 163 which is part of the printhead die 160 and has an array of nozzles 180 which correspond to and overlie the thermal ejection chambers. The printhead 100 is thus sealed by the nozzle plate 163 but permits ink flow 170 from the printhead ink chamber 175 via the nozzles 180 in the nozzle plate 163.

In an embodiment, a positive pressure printhead priming event may include the following steps: (a) a pressurized ink delivery system 120 delivers ink to a printhead regulator inlet valve 130; (b) a peristaltic pump 110 is actuated to provide pressurized air to inflate air bags within a printhead regulator 140, in turn separating levers that open the printhead regulator inlet valve 130; (c) pressurized ink 170 flows through the printhead regulator 140, printhead chamber 175, ink channels, and nozzles 180 cleaning out unwanted debris. In an embodiment, negative pressure may be applied at the bottom of the printhead 100 to cause inflation of the air bags and thereby initiate a priming event.

Figure 2:
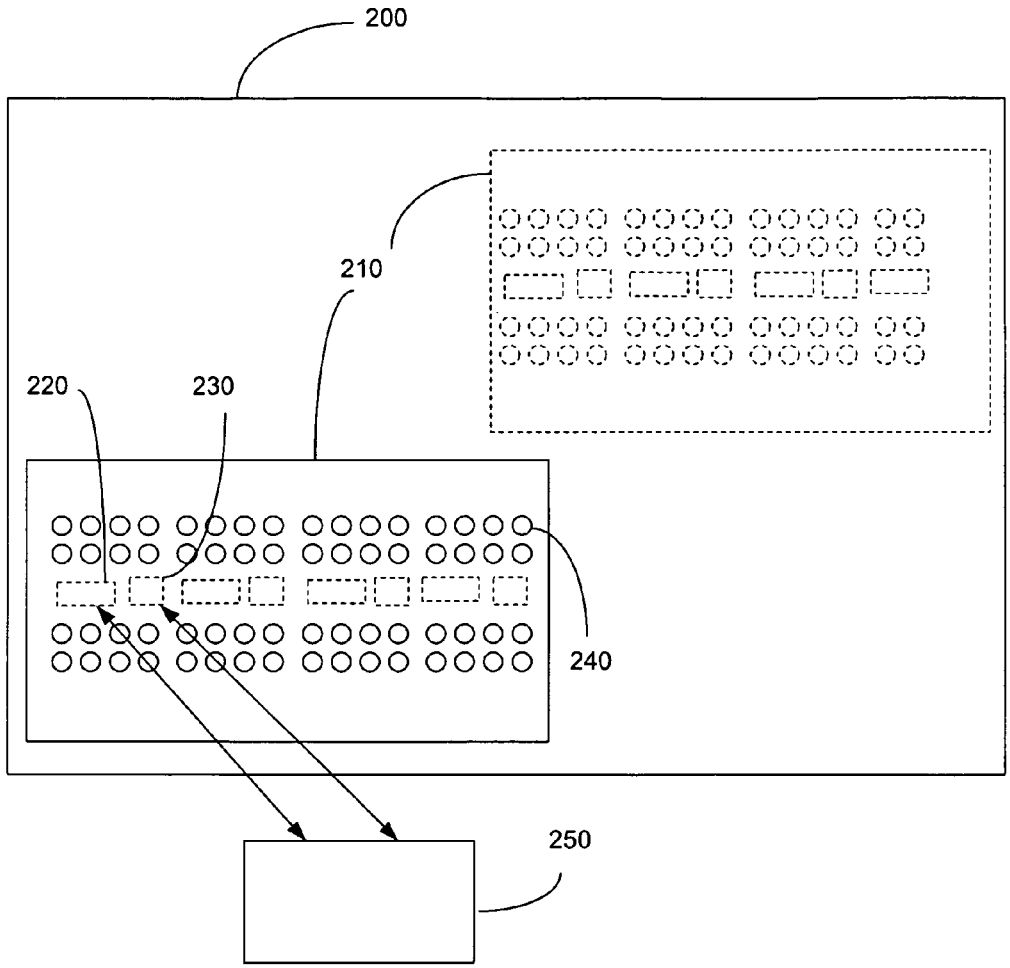
FIG. 2 is a diagram showing a bottom view of a printhead including two printhead dies, and a system for monitoring ink flow to confirm the success of a priming event, according to one embodiment of the invention.

FIG. 2 is a diagram showing a bottom view of a printhead including two printhead die, and a system for monitoring ink flow to confirm the success of a priming event, according to one embodiment of the invention. The system according to an embodiment includes a printhead 200 with a printhead die 210, a heating element 220, a sensor 230 and a processor 250.

In an embodiment the printhead 200 includes multiple printhead dies 210 and is configured to perform a priming event. As used in the present specification and in the appended claims, the term "priming event" suggests a maintenance routine to clean a printhead by forcibly extracting ink from the printhead. In an embodiment, the system may utilize positive pressure or negative pressure gradients to execute a priming event.

The printhead die 210 connects to a heating element 220, which heating element 220 is configured to raise the temperature of the printhead die 210 to a pre-determined start-priming temperature. In an embodiment, heating elements 220 include resistors that are embedded in the printhead die 210. These resistors may include resistors that are also used as warming circuitry during the printing process. In an embodiment, the heating elements 220 may be external to the printhead die 210, and dedicated to the system for monitoring ink flow.

Printhead die 210 also connects to at least one sensor 230. In an embodiment, the sensor is configured to make a number of measurements:

a. one or more measurements to confirm when the heating element has raised the temperature of the printhead die to a predetermined start-priming temperature; and b. a series of priming measurements.

As used in the present specification and in the appended claims, the term "priming measurement" suggests a measurement of the temperature of the printhead die that takes place during or after the priming event.

The heating element and the at least one sensor are coupled to a processor 250. As used in the present specification and in the appended claims, the term "processor" suggests logic circuitry that responds to and processes instructions so as to control a system. In an embodiment the processor 250 controls the heating element so as to raise the temperature of the printhead die to 65 degrees C., and then turn off the heating element just before the priming event initiates. The processor 250 is configured to calculate at least one actual cooling rate utilizing priming measurements made by the sensor. The processor 250 then determines whether or not the priming event was successful by comparing the actual cooling rate to a predetermined threshold cooling rate that indicates ink flow through the printhead. If the priming event was unsuccessful, the cooling of the printhead die 210 is led by the convection process with the external air surrounding the printhead. In an embodiment, the cooling speed as a factor of the external air temperature has been measured to peak below −20 degrees C./second.

If the priming event is successful, some amount of ink is extracted from the printhead 200. This ink, when flowing through the die, accelerates the cooling speed of the die, as the ink inside the printhead 200 is cooler than the start-priming temperature that was induced in the die by the heating elements 220. Thus, the measured cooling rate is greater when there is a successful priming event as compared to when there is an unsuccessful priming event as there is a sum of air cooling effects plus ink cooling effects.

Figure 3:
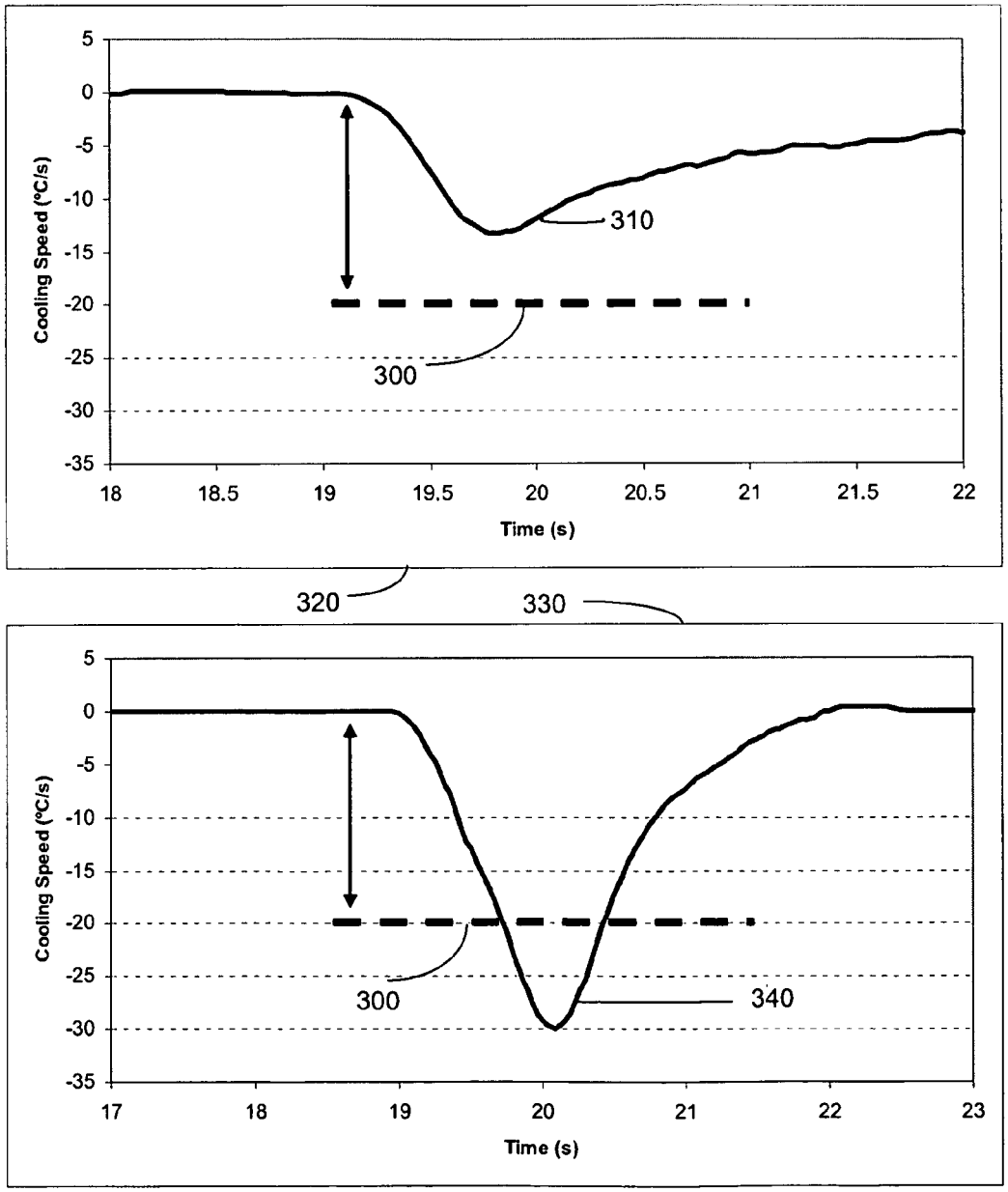
FIG. 3 is a graph that illustrates the difference in the cooling speeds of a printhead die during an unsuccessful priming event as compared to a successful priming event, according to an embodiment of the invention.

FIG. 3 is a graph that illustrates the difference in the cooling speeds of a printhead during an unsuccessful priming event as compared to a successful priming event, according to an embodiment of the invention. The graphs' X axes represent seconds, and the Y axes represent cooling rates expressed in degrees C./second. Graph One 320 illustrates an example predetermined threshold cooling temperature 300 of −20 degrees C./second, such that a computed actual cooling rate of less than −20 degrees C./second indicates an unsuccessful priming event. Graph One 320 illustrates an example plotting of cooling speeds for a printhead die that fails to reach the threshold cooling speed of −20 degrees C./second. This result indicates an unsuccessful priming event 310. Graph Two 330 illustrates the plotting of cooling speeds for a printhead die which exceeds the threshold cooling speed of −20 degrees C./second. This result indicates a successful printing event 340.

Figure 4:
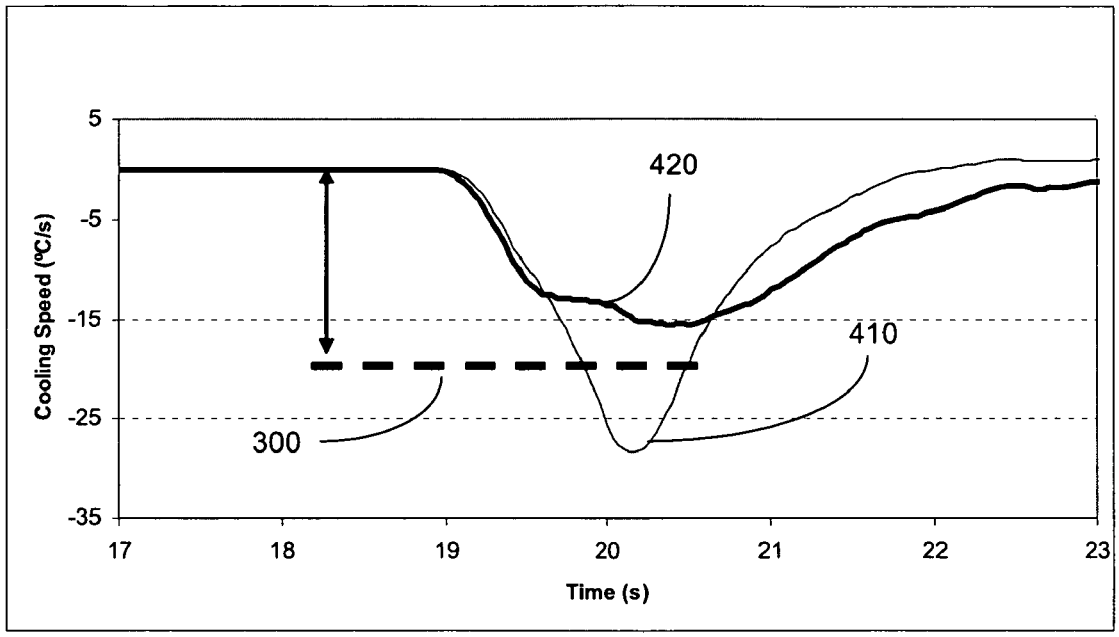
FIG. 4 is a graph that illustrates the how the measurement of cooling speeds can be used to identify successful versus unsuccessful priming events on a nozzle group by nozzle group basis in a printhead, according to an embodiment of the invention.

FIG. 4 is a graph that illustrates the how the measurement of cooling speeds can be used to identify successful versus unsuccessful priming vents on a nozzle group by nozzle group basis in a printhead. As used in the present specification and in the appended claims, the term "nozzle group" suggests a set of nozzles with a common characteristic, such as the color of ink to be expelled, physical location in the die or printhead, or common physical attributes. In an embodiment nozzles are grouped according to the color of ink to be expelled. In an embodiment nozzles are grouped according to their location on the die or printhead. In an embodiment nozzles are grouped according to common physical attributes. As in FIG. 3, the X axis represents seconds, and the Y axis represents degrees C./second. In an example, a multicolor printing device contains a left nozzle group and a right nozzle group, and expresses a single color through each nozzle group. When a recovery priming event for such an example printhead is triggered, the two nozzle groups (one color per nozzle group) are primed at the same time. The system and method for monitoring ink flow disclosed herein are able to detect when a specific nozzle group has not been able to eject ink from the printhead. The diagram at FIG. 4 illustrates a left nozzle group 410 that when primed reaches a threshold cooling speed of −25 degrees C./second, and a right nozzle group 420 that does not successfully prime and cools at a rate that does not exceed −15 degrees C./second. As the die is a single piece of silicon, some of the heat is transferred from one nozzle group to another. This accounts for the faster cooling speed of the right nozzle group that is not primed in this FIG. 4 as compared to the case in FIG. 3 where no priming was indicated by a cooling speed of less than −10 degrees C./second. In an embodiment, the disclosed system distinguishes between the following events: (a) no priming event, (b) the left nozzle group is not primed, (c) the right nozzle group is not primed, and (d) both nozzle groups are successfully primed.

Figure 5:
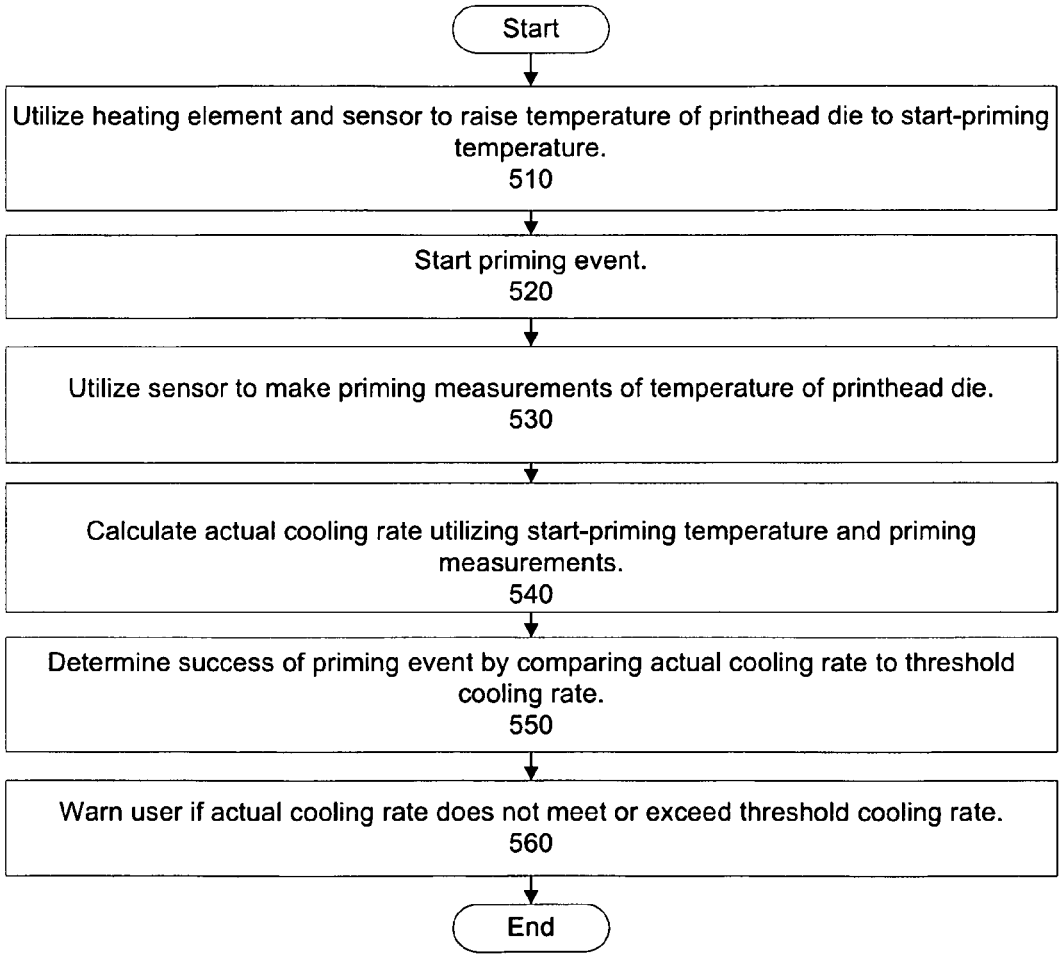
FIG. 5 is a diagram of a method for monitoring ink flow to confirm the success of a priming event, according to one embodiment of the invention.

FIG. 5 is a diagram of a method for monitoring ink flow to confirm the success of a priming event, according to one embodiment of the invention. The method of FIG. 5 begins at block 510 in which a heating element and a sensor are utilized to raise the temperature of the printhead die to a start-priming temperature. In an embodiment the sensor is a resistor embedded in the printhead die, configured to perform a heating operation during the print process as well as the priming event. The next step in the method at block 520 is the commencement of the priming event. In an embodiment the heating element is turned off and the priming event begins when the sensor detects that the start-priming temperature has been reached. The next step in the method at block 530 is to utilize the sensor to make priming measurements of the temperature of the printhead die. The next step in the method at block 540 is to calculate an actual cooling rate utilizing the start-priming temperature and the priming measurements. The next step in the method at block 550 is to determine the success of the priming event by comparing the actual cooling rate to the threshold cooling rate. If the actual cooling rate is equal to or exceeds the pre-established threshold cooling rate, a successful priming event has occurred. If the actual cooling rate is less than the pre-established threshold cooling rate, the priming event failed. The next step in the method at block 560 is to warn the user if the actual cooling rate does not meet or exceed the threshold cooling rate. With the knowledge that a priming event has failed, the user can initiate recovery actions that will improve print quality and avoid damage to the printing device.

Figure 6:
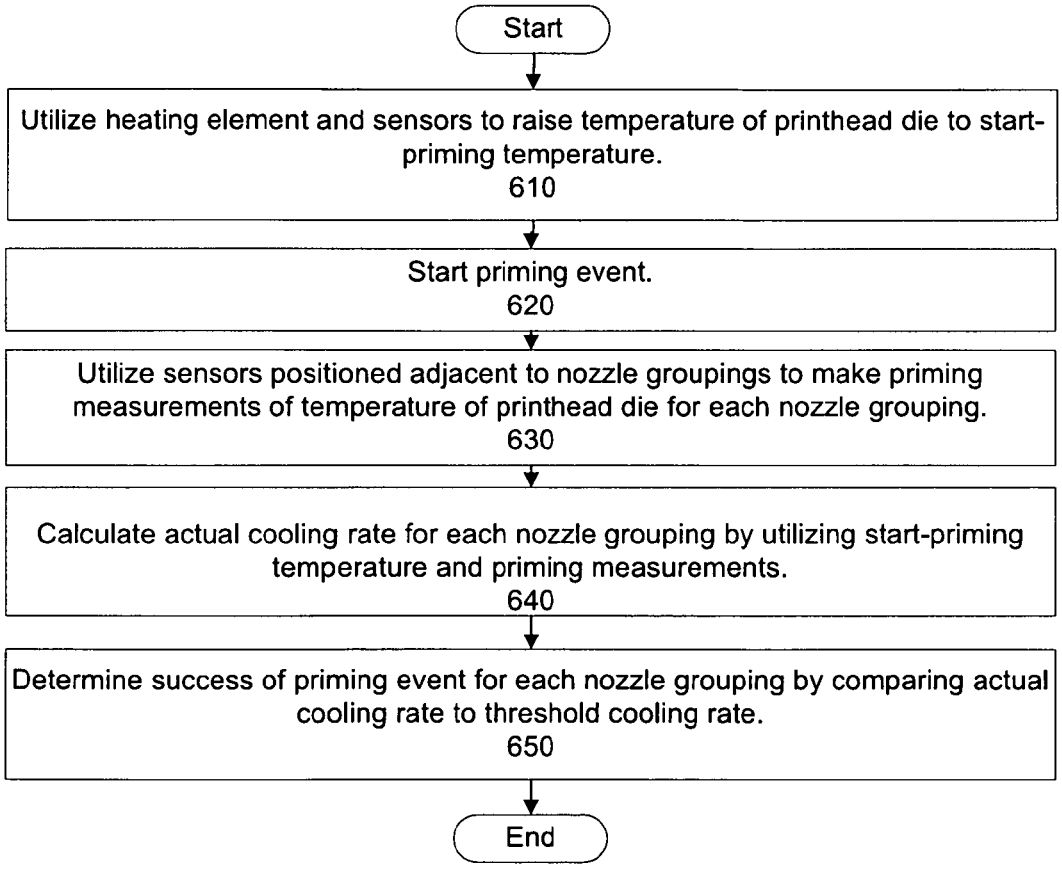
FIG. 6 is a diagram of a method for monitoring ink flow to confirm the success of a priming event, according to one embodiment of the invention.

FIG. 6 is a diagram of a method for monitoring ink flow to confirm the success of a priming event, according to one embodiment of the invention. The method of FIG. 6 begins at block 610 in which a heating element and a sensor are utilized to raise the temperature of the printhead die to a start-priming temperature. Once the start-priming temperature has been achieved, the priming event is initiated at block 620. The next step in the method at block 630 is to utilize sensors adjacent to nozzle groups to make priming measurements of the temperature of the printhead die for each nozzle group. In an embodiment nozzles are grouped according to the color of ink to be expelled. In an embodiment nozzles are grouped according to their location on the die or printhead. In an embodiment nozzles are grouped according to common physical attributes. The next step in the method at block 640 is to calculate an actual cooling rate for each nozzle group utilizing the start-priming temperature and the priming measurements. The next step in the method at block 650 is to determine the success of the priming event by comparing the actual cooling rate to the pre-established threshold cooling rate for each nozzle group. If the actual cooling rate for a nozzle group is equal to or exceeds the threshold cooling rate, a successful priming event has occurred for that nozzle group. If the actual cooling rate for a nozzle group is less than the threshold cooling rate, the priming event failed for that nozzle group.

The preceding description has been presented only to illustrate and describe embodiments and examples of the principles described. This description is not intended to be exhaustive or to limit these principles to any precise form disclosed. Many modifications and variations are possible in light of the above teaching.

What is claimed is:

1. A method for monitoring ink flow, comprising:

utilizing a heating element and a sensor to raise temperature of a printhead die to a start-priming temperature;

performing a priming event;

utilizing a plurality of sensors, respectively positioned adjacent to a plurality of nozzle groups, to make priming measurements of temperature of the printhead die at a plurality of times;

calculating actual cooling rates for the nozzle groups utilizing the start-priming temperature and the priming measurements; and determining success of the priming event for the nozzle groups by comparing the actual cooling rates to a threshold cooling rate.

2. The method of claim 1, further comprising warning a user that the priming event was not successful if an actual cooling rate does not meet or exceed the threshold cooling rate.

3. The method of claim 1, wherein performing the priming event comprises propelling ink out of the printhead.

4. The method of claim 1, wherein performing the priming event comprises suctioning ink out of the printhead.

5. The method of claim 1, wherein the plurality of sensors are embedded in the printhead die.

6. The method of claim 1, wherein each of the plurality of sensors comprises a resistor.

7. A system for monitoring ink flow, comprising:

a printhead comprising a printhead die, wherein the printhead is configured to perform a priming event;

a heating element coupled to the printhead die;

a plurality of sensors coupled to the printhead die, respectively positioned adjacent to a plurality of nozzle groups within the printhead die;

wherein a sensor is configured to confirm when the printhead die has reached a start-priming temperature, and wherein the plurality of sensors are configured to make priming measurements of temperature of the printhead die at a plurality of times;

a processor coupled to the heating element and the plurality of sensors, wherein the processor is configured to:

calculate actual cooling rates for the nozzle groups utilizing the start-priming temperature and the priming measurements, and determine success of the priming event for the nozzle groups by comparing the actual cooling rates to a threshold cooling rate.

8. The system of claim 7, further comprising a communication device configured to warn a user that the priming event was not successful if an actual cooling rate does not meet or exceed the threshold cooling rate.

9. The system of claim 7, wherein the priming event comprises propelling ink out of the printhead.

10. The system of claim 7, wherein the priming event comprises suctioning ink out of the printhead.

11. The system of claim 7, wherein the plurality of sensors are embedded in the printhead die.

12. The system of claim 7, wherein each of the plurality of sensors comprises a resistor.

13. A non-transitory computer-readable medium having computer executable instructions thereon which, when executed, cause a processor to perform a method, the method comprising:

utilizing a heating element and a sensor to raise temperature of a printhead die to a start-priming temperature;

performing a priming event;

utilizing a plurality of sensors, respectively positioned adjacent to a plurality of nozzle groups, to make priming measurements of temperature of the printhead die at a plurality of times;

calculating actual cooling rates for the nozzle groups utilizing the start-priming temperature and the priming measurements; and determining success of the priming event for the nozzle groups by comparing the actual cooling rates to a threshold cooling rate.

14. The medium of claim 13, wherein the method further comprises warning a user that the priming event was not successful if an actual cooling rate does not meet or exceed the threshold cooling rate.

15. The medium of claim 13, wherein performing the priming event comprises propelling ink out of the printhead.

16. The medium of claim 13, wherein the plurality of sensors are embedded in the printhead die.

17. The medium of claim 13, wherein each of the plurality of sensors comprises a resistor.

* * * * *